US011564853B1

(12) United States Patent
Delise et al.

(10) Patent No.: US 11,564,853 B1
(45) Date of Patent: Jan. 31, 2023

(54) HYPERBARIC VEHICLE AND TRANSFER UNDER PRESSURE (TUP) UNIT

(71) Applicants: Christian Delise, New Orleans, LA (US); Bobby Delise, New Orleans, LA (US)

(72) Inventors: Christian Delise, New Orleans, LA (US); Bobby Delise, New Orleans, LA (US)

( * ) Notice: Subject to any disclaimer, the term of this patent is extended or adjusted under 35 U.S.C. 154(b) by 287 days.

(21) Appl. No.: 16/741,322

(22) Filed: Jan. 13, 2020

Related U.S. Application Data

(60) Provisional application No. 62/791,248, filed on Jan. 11, 2019.

(51) Int. Cl.
*A61G 3/00* (2006.01)
*A61G 10/02* (2006.01)

(52) U.S. Cl.
CPC ..... *A61G 3/001* (2013.01); *A61G 3/008* (2013.01); *A61G 10/026* (2013.01)

(58) Field of Classification Search
CPC ..... A61G 10/00; A61G 10/02; A61G 10/04; A61G 10/026; A61G 10/023; A61G 3/001;
(Continued)

(56) References Cited

U.S. PATENT DOCUMENTS 3,500,648 A 3/1970 Daniell
3,587,574 A 6/1971 Mercer
(Continued)

FOREIGN PATENT DOCUMENTS

CN 2715737 8/2005
CN 203619824 6/2014
(Continued)

OTHER PUBLICATIONS

PCT International Search Report and Written Opinion of the International Searching Authority dated Mar. 29, 2018; PCT/US2017/061480; Filed Nov. 14, 2017.

*Primary Examiner* — Lori L Lyjak
(74) *Attorney, Agent, or Firm* — Garvey, Smith & Nehrbass, Patent Attorneys, L.L.C.; Vanessa M. D'Souza; Charles C. Garvey, Jr.

(57) ABSTRACT

The present invention relates to a hyperbaric ambulance and transfer-under-pressure (TUP) unit. More particularly, the present invention relates to a vehicle for emergency transport and treatment of a patient that is capable of providing hyperbaric oxygen treatment to the patient, and a mobile unit for transferring the patient from the vehicle to a medical care facility. More particularly, the present invention includes a vehicle having a driver section and a vehicle chassis having a patient section that includes a hyperbaric treatment chamber. An entrance module can be positioned in between the driver section and the patient section, the entrance module having a communication and control compartment and a pressure module. The pressure module can have at least two pressure hatches, wherein at least one of the at least two pressure hatches allows personnel to enter the pressure module from the control compartment, and at least one of the at least two pressure hatches allows personnel to enter the treatment chamber from the pressure module. The pressure module enables a user to selectively enter or exit the entrance module while simultaneously maintaining a selected elevated pressure value in said patient section, and preferably enables a user to selectively enter or exit said hyperbaric treatment chamber from the entrance module while simultaneously maintaining a selected elevated pressure value in the patient section.

20 Claims, 10 Drawing Sheets

(58) Field of Classification Search
CPC . A61G 3/00; B62D 63/025; B60P 3/14; B60P 3/32
See application file for complete search history.

(56) References Cited

U.S. PATENT DOCUMENTS

| | | | | |
|---|---|---|---|---|
| 4,227,524 | A | 10/1980 | Galerne | |
| 4,467,798 | A | 8/1984 | Saxon et al. | |
| 5,593,272 | A | 1/1997 | Green | |
| 5,626,151 | A | 5/1997 | Linden | |
| 5,685,293 | A | 11/1997 | Watt | |
| 5,964,065 | A | 10/1999 | Migurski | |
| 6,062,215 | A | 5/2000 | Leininger et al. | |
| 6,461,290 | B1 | 10/2002 | Reichman et al. | |
| 6,488,029 | B1 | 12/2002 | Hood et al. | |
| 6,497,231 | B1 * | 12/2002 | White | A61G 10/026 128/205.26 |
| 6,668,950 | B2 | 12/2003 | Park | |
| 6,899,103 | B1 | 5/2005 | Hood et al. | |
| 9,138,366 | B2 | 9/2015 | Radko | |
| 9,186,232 | B1 | 11/2015 | Otto | |
| 2008/0210234 | A1 | 9/2008 | O'Brien et al. | |
| 2009/0250063 | A1 | 10/2009 | Gaumond et al. | |
| 2013/0047988 | A1 | 2/2013 | Delp, II et al. | |
| 2018/0133074 | A1 * | 5/2018 | Delise | A61G 3/001 |

FOREIGN PATENT DOCUMENTS

| | | | |
|---|---|---|---|
| CN | 104398359 | | 3/2015 |
| DE | 4114177 | | 11/1991 |
| FR | 2570657 | | 3/1986 |
| RU | 2023441 | C1 * | 11/1994 |
| WO | WO2006053395 | | 5/2006 |
| WO | WO2007012710 | | 1/2007 |

* cited by examiner

HYPERBARIC VEHICLE AND TRANSFER UNDER PRESSURE (TUP) UNIT

CROSS-REFERENCE TO RELATED APPLICATIONS

This application claims benefit of and/or priority to U.S. Provisional Patent Application No. 62/791,248, filed 11 Jan. 2019, which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a hyperbaric rescue vehicle or ambulance and a transfer-under-pressure (TUP) unit. More particularly, the present invention relates to a vehicle for rescue/emergency transport and treatment of a patient that is capable of providing hyperbaric oxygen treatment to the patient, and a mobile unit for transferring the patient from the vehicle to a medical facility.

2. General Background of the Invention

The benefits of hyperbaric oxygen treatment (HBO) are well-known; however, due to the nature of the ability to offer this type of treatment outside of an equipped medical treatment facility and/or during patient transport, HBO treatment is currently unavailable outside a treatment facility and/or during patient transport in the prior art. Thus, there is a need for an apparatus and method that can provide HBO to a patient during transport from a remote location to an equipped medical facility, reducing delays in HBO treatment.

U.S. Provisional Patent Application Ser. No. 62/421,955, filed 14 Nov. 2016; U.S. patent application Ser. No. 15/812,181, filed 14 Nov. 2017, published as US-2018-0133074-A1 on 17 May 2018; and PCT International Application No. PCT/US2017/061480, filed 14 Nov. 2017, published as International Publication No. WO 2018/089982 on 17 May 2018, are hereby incorporated herein by reference.

The following US Patents and Publications are incorporated herein by reference:

| PAT/ PUB NO. | TITLE | ISSUE/ PUB DATE MM/DD/YYYY |
|---|---|---|
| 5,626,151 | Transportable life support system | May 6, 1997 |
| 6,062,215 | Hyperbaric oxygen patient treatment system | May 16, 2000 |
| 6,461,290 | Collapsible isolation apparatus | Oct. 8, 2002 |
| 6,497,231 | Hyperbaric oxygen chamber | Dec. 24, 2002 |
| 6,899,103 | Self contained transportable life support system | May 31, 2005 |
| 9,138,366 | Hyperbaric apparatus with storage compartment | Sep. 22, 2015 |
| 2009/0250063 | HYPERBARIC/HYPOXIC CHAMBER SYSTEM | Oct. 8, 2009 |

-continued

| PAT/ PUB NO. | TITLE | ISSUE/ PUB DATE MM/DD/YYYY |
|---|---|---|
| 2013/0047988 | Hyperbaric Chamber System and Related Methods | Feb. 28, 2013 |

The following Foreign Patents are hereby incorporated herein by reference: CN2715737; CN104398359; CN203619824.

BRIEF SUMMARY OF THE INVENTION

The apparatus of the present invention is an emergency medical or rescue vehicle, such as, for example, an ambulance, that can provide emergency hyperbaric oxygen treatment for patients suffering from ailments and illnesses that can be cured or severities lessened in the critical time post incident. The vehicle preferably provides hyperbaric oxygen treatment in route to a health care facility so that the benefits of such treatment can be provided prior to admission into the facility.

The vehicle preferably includes the requisite gases for treatment for the patient and for sustaining of the presence of the medical care providers rendering care and support to the patient in the ambulance.

The vehicle preferably has all of the requisite medical supplies and monitors to provide treatment to the patient for all of the instances of patient care with or without hyperbaric oxygen treatment.

The vehicle preferably includes all of the communications capabilities to provide real time information to the destination medical facility in order to provide the medical facility's providers with medical status of the incoming patient.

The vehicle preferably includes a "treatment pressure lock" which provides the hyperbaric conditions environment to the patient, the medical supplies and monitoring controls. Preferably, another lock, the "entrance lock module," allows for medical providers to enter and exit the treatment pressure lock without changing the pressure within the treatment pressure lock.

Preferably, the vehicle includes a third compartment, the "medical communications/hyperbaric controls center," which provides an area for a hyperbaric medical technician to control the pressure and gas supplies to the treatment pressure lock area, and to provide data via communications radios and internet interface with the destination medical facility.

The vehicle is preferably equipped with a $H_2O$ fire suppression system for the interior spaces.

The vehicle preferably has a pressurized capable entrance and exit door and at least one atmosphere entrance/exit door for the medical communications/hyperbaric controls center.

The vehicle preferably contains the requisite audio sirens and lights required of ambulances pursuant to local and national legal standards.

The present invention preferably includes a Transfer Under Pressure (TUP) Unit, which preferably provides a pressurized environment to transfer a patient from the emergency vehicle to a facility-based hyperbaric chamber without having the patient lose the benefits from hyperbaric treatment during the travel from the scene of the pick up to the facility.

Preferably, the TUP Unit has the requisite high pressurization capability and gases needed for the patient and the medical care provider during the time of transfer from the ambulance to the facility chamber. The TUP Unit preferably has a transfer lock capable of mating with an emergency vehicle at pressure and, preferably has a transfer lock capable of mating with a hyperbaric chamber at the destination medical facility.

The TUP Unit is preferably capable of independent movement a distance from the ambulance or emergency vehicle to a hyperbaric chamber at the destination medical facility, e.g., preferably via electric motors and a power unit at the base of the TUP Unit.

In one or more preferred embodiments, the present invention includes a vehicle for providing hyperbaric oxygen treatment during transfer of a patient to a medical facility, the vehicle including a driver section and a patient section, wherein the patient section includes a hyperbaric treatment chamber, an entrance module, and a communication and control compartment.

In various embodiments, the entrance module can be used to allow medical personnel to enter and exit the hyperbaric treatment chamber without disrupting the pressure established in the treatment chamber.

In various embodiments, the pressure in the treatment chamber and entrance module are preferably controlled by a technician in the control compartment.

In various embodiments, the present invention further includes a locker box, wherein the vehicle has a left side and a right side, and the locker box preferably can be accessible from the left side of the vehicle, the locker box preferably holding an air receiver and an air compressor for the hyperbaric treatment chamber. The locker box is preferably on the left side of the vehicle given typical set up of an emergency vehicle and drop off location at a medical facility, but the locker box can be included on another side of the vehicle if desired.

In various embodiments, the present invention further includes a locker box, wherein the vehicle has a first side and a second side, and the locker box can be accessible from the first or the second side of the vehicle, the locker box preferably holding an air receiver and an air compressor for the hyperbaric treatment chamber.

In various embodiments, the hyperbaric treatment chamber can include medical supply cabinets for storing medical supplies and monitors for ambulatory patient care, and a patient gurney.

In various embodiments, the entrance module can have at least two pressure hatches, at least one of the at least two pressure hatches preferably allows personnel to enter the entrance module from the control compartment of the vehicle, and at least one of the at least two pressure hatches preferably allows personnel to enter the treatment chamber from the entrance module.

In various embodiments, the treatment chamber includes at least two pressure lock entrances, at least one of the at least two pressure lock entrances is preferably the pressure hatch to the entrance module, and at least one of the at least two pressure lock entrances is preferably a pressure lock entrance to the exterior of the vehicle.

In various embodiments, the present invention can further comprise an external locker box that contains high pressure air, high pressure $N_2$, and high pressure $O_2$ for maintaining the treatment chamber.

In various embodiments, the present invention can further comprise an $H_2O$ fire suppression tank.

In various embodiments, the vehicle can have a side entrance that allows personnel to enter and exit the communication and control compartment.

In various embodiments, the pressure lock entrance from the treatment chamber to the exterior of the vehicle is preferably capable of mating with a pressure lock of a transfer-under-pressure (TUP) unit, the TUP unit comprising front and rear transfer locks, an external locker box, a view port, and a control panel, wherein at least one of the transfer locks is able to mate with the pressure lock of the treatment chamber of the vehicle, and at least one of the transfer locks is able to mate with a pressure lock of a hyperbaric treatment chamber in a medical facility, and wherein the external locker box contains at least an air receiver, an air compressor, and high pressure gas cylinders for maintaining the treatment pressure for the patient during transfer from the vehicle to the medical facility.

In various embodiments, the TUP unit can further comprise a Built-In Breathing System (BIBS) console.

In various embodiments, the TUP unit can further comprise electric motors and a power unit that is capable of moving the TUP unit at least the distance from the vehicle to the medical facility hyperbaric treatment chamber.

In various embodiments, the TUP unit can further comprise wheels to aid in moving the TUP unit from the vehicle to the medical facility.

One or more preferred embodiments of the present invention includes a transfer-under-pressure (TUP) unit for transferring a patient undergoing hyperbaric oxygen treatment (HBO) from an emergency or rescue vehicle equipped with an HBO chamber, to a medical facility equipped with an HBO chamber, the TUP unit including front and rear transfer locks, an external locker box, a view port, and a control panel, wherein at least one of the transfer locks is able to mate with a pressure lock of the HBO chamber of the emergency vehicle, and at least one of the transfer locks is able to mate with a pressure lock of the HBO chamber of the medical facility, and wherein the external locker box contains at least an air receiver, an air compressor, and high pressure gas cylinders for maintaining the HBO treatment pressure for the patient during transfer from the emergency or rescue vehicle to the medical facility.

In various embodiments, the TUP unit can further include a BIBS console.

In various embodiments, the TUP unit can further include electric motors and a power unit that is capable of moving the TUP unit at least the distance from the vehicle to the medical facility hyperbaric treatment chamber.

In various embodiments, the TUP unit can further comprise wheels to aid in moving the TUP unit from the vehicle to the medical facility.

In various embodiments, the TUP unit is movable and adapted to move at least the distance from the emergency or rescue vehicle to the medical facility hyperbaric treatment chamber.

One or more preferred embodiments of the present invention includes a vehicle for providing hyperbaric oxygen treatment during transfer of a patient to a medical facility, comprising a driver section and a vehicle chassis having a patient section that includes a hyperbaric treatment chamber. An entrance module can be positioned in between the driver section and the patient section. The entrance module can include a communication and control compartment, wherein the control compartment preferably enables a user to selectively enter or exit the entrance module while preferably simultaneously maintaining a selected elevated pressure value in the patient section.

In various embodiments, the entrance module preferably has one or more doors that enable medical personnel to enter and exit the hyperbaric treatment chamber without disrupting an elevated pressure value established in the treatment chamber.

In various embodiments, pressure valves in the treatment chamber and entrance module can be controlled by a technician positioned in the control compartment.

In various embodiments, the entrance module further includes a locker box holding an air receiver and an air compressor for elevating pressure in the hyperbaric treatment chamber.

In various embodiments, the hyperbaric treatment chamber preferably includes one or more medical supply cabinets for storing medical supplies.

In various embodiments, the entrance module preferably has at least two pressure hatches, wherein at least one of the at least two pressure hatches preferably allows personnel to enter the module from the control compartment, and at least one of the at least two pressure hatches preferably allows personnel to enter the treatment chamber from the entrance module.

In various embodiments, the treatment chamber preferably includes at least two pressure lock entrances, wherein at least one of the at least two pressure lock entrances is the pressure hatch to the entrance module, and at least one of the at least two pressure lock entrances is a pressure lock entrance to the exterior of the vehicle from the treatment chamber.

In various embodiments, the vehicle further comprising an external locker box that contains on or more cylinders of high pressure air, gas for maintaining a selected pressure in the treatment chamber.

In various embodiments, the vehicle further comprising an $H_2O$ fire suppression tank. In various embodiments, the vehicle can have a side entrance that allows personnel to access the communication and control compartment.

In various embodiments, the pressure lock entrance from the treatment chamber to the exterior of the vehicle is configured to mate with a pressure lock of a transfer-under-pressure (TUP) unit.

In various embodiments, the TUP unit includes front and rear transfer locks, an external locker box, a view port, and a control panel, wherein at least one of the transfer locks is able to mate with the pressure lock of the treatment chamber of the vehicle, and at least one of the transfer locks is able to mate with a pressure lock of a hyperbaric treatment chamber in a medical facility, and wherein the external locker box contains at least an air receiver, an air compressor, and high pressure gas cylinders for maintaining the treatment pressure for the patient during transfer from the vehicle to the medical facility.

In various embodiments, the TUP further comprises a BIBS console.

In various embodiments, the TUP further comprises a power unit that is capable of moving the TUP at least the distance from the vehicle to the medical facility hyperbaric treatment chamber.

In various embodiments, the TUP further comprises wheels to aid in moving the TUP from the vehicle to the medical facility.

One or more preferred embodiments of the present invention includes a transfer-under-pressure (TUP) unit for transferring a patient undergoing hyperbaric oxygen treatment (HBO) from a rescue vehicle equipped with an HBO chamber to a medical facility equipped with an HBO chamber, comprising a TUP unit having front and rear transfer locks, an external locker box, a view port, and a control panel, wherein at least one of the transfer locks is preferably configured to mate with a pressure lock of the HBO chamber of the rescue vehicle, wherein at least one of the transfer locks is preferably configured to mate with a pressure lock of the HBO chamber of the medical facility, and wherein the external locker preferably contains at least an air receiver, an air compressor, and high pressure gas cylinders for maintaining the HBO treatment pressure for the patient during transfer from the emergency vehicle to the medical facility.

In various embodiments, further comprises a BIBS console.

In various embodiments, the TUP further comprises electric motors and a power unit that is capable of moving the TUP unit at least the distance from the vehicle to the medical facility hyperbaric treatment chamber.

One or more preferred embodiments of the present invention includes a vehicle for providing hyperbaric oxygen treatment during transfer of a patient to a medical facility, comprising a driver section and a vehicle chassis having an unpressurized patient section, an entrance module positioned in between the driver section and the patient section, wherein the entrance module is pressurized, and a communication and control compartment in the entrance module.

One or more preferred embodiments of the present invention includes a vehicle for providing hyperbaric oxygen treatment during transfer of a patient to a medical facility, comprising a driver section and a vehicle chassis having a patient section that includes a hyperbaric treatment chamber.

One or more preferred embodiments of the present invention includes a vehicle for providing hyperbaric oxygen treatment during transfer of a patient to a medical care facility, comprising a driver section and a vehicle chassis having a patient section that includes a hyperbaric treatment chamber. An entrance module can be positioned in between the driver section and the patient section, the entrance module preferably having a communication and control compartment and a pressure module. Pressure values of the hyperbaric treatment chamber and pressure module are preferably controlled by a technician positioned in the control compartment. The pressure module preferably has at least two pressure hatches, wherein at least one of the at least two pressure hatches allows personnel to enter the pressure module from the control compartment, and at least one of the at least two pressure hatches allows personnel to enter the treatment chamber from the pressure module. The treatment chamber preferably includes at least two pressure lock entrances, wherein at least one of the at least two pressure lock entrances is the pressure hatch to the entrance module, and at least one of the at least two pressure lock entrances is a pressure lock entrance to the exterior of the vehicle from the treatment chamber. The pressure module preferably enables a user to selectively enter or exit the entrance module while simultaneously maintaining a selected elevated pressure value in the patient section. The pressure module preferably enables a user to selectively enter or exit the hyperbaric treatment chamber from the entrance module while simultaneously maintaining a selected elevated pressure value in the patient section.

In various embodiments, the entrance module has one or more doors that enable medical personnel to enter and exit the hyperbaric treatment chamber without disrupting an elevated pressure value established in the treatment chamber.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
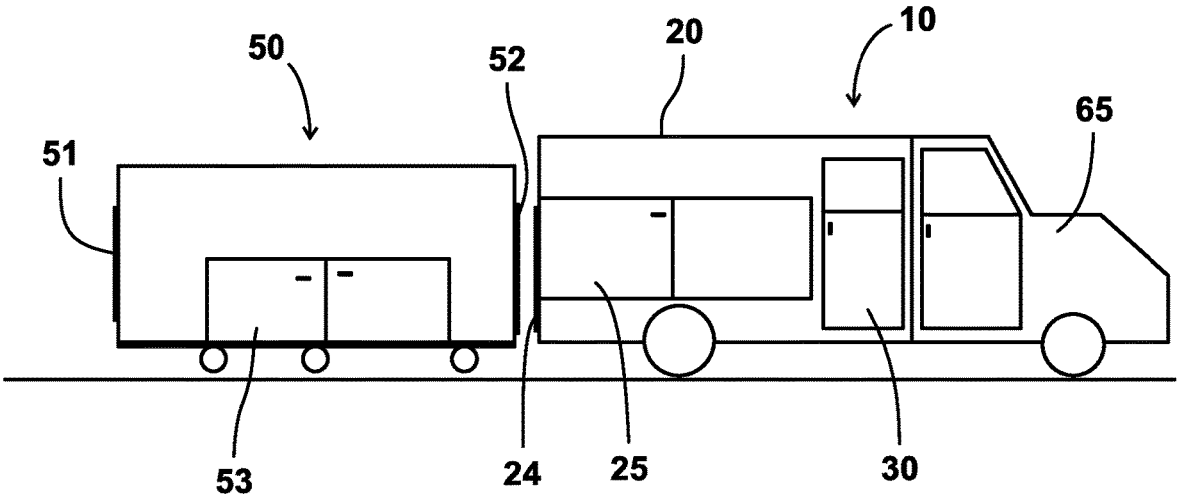
FIG. 1 is a side view of a preferred embodiment of the apparatus of the present invention.
Figure 18:
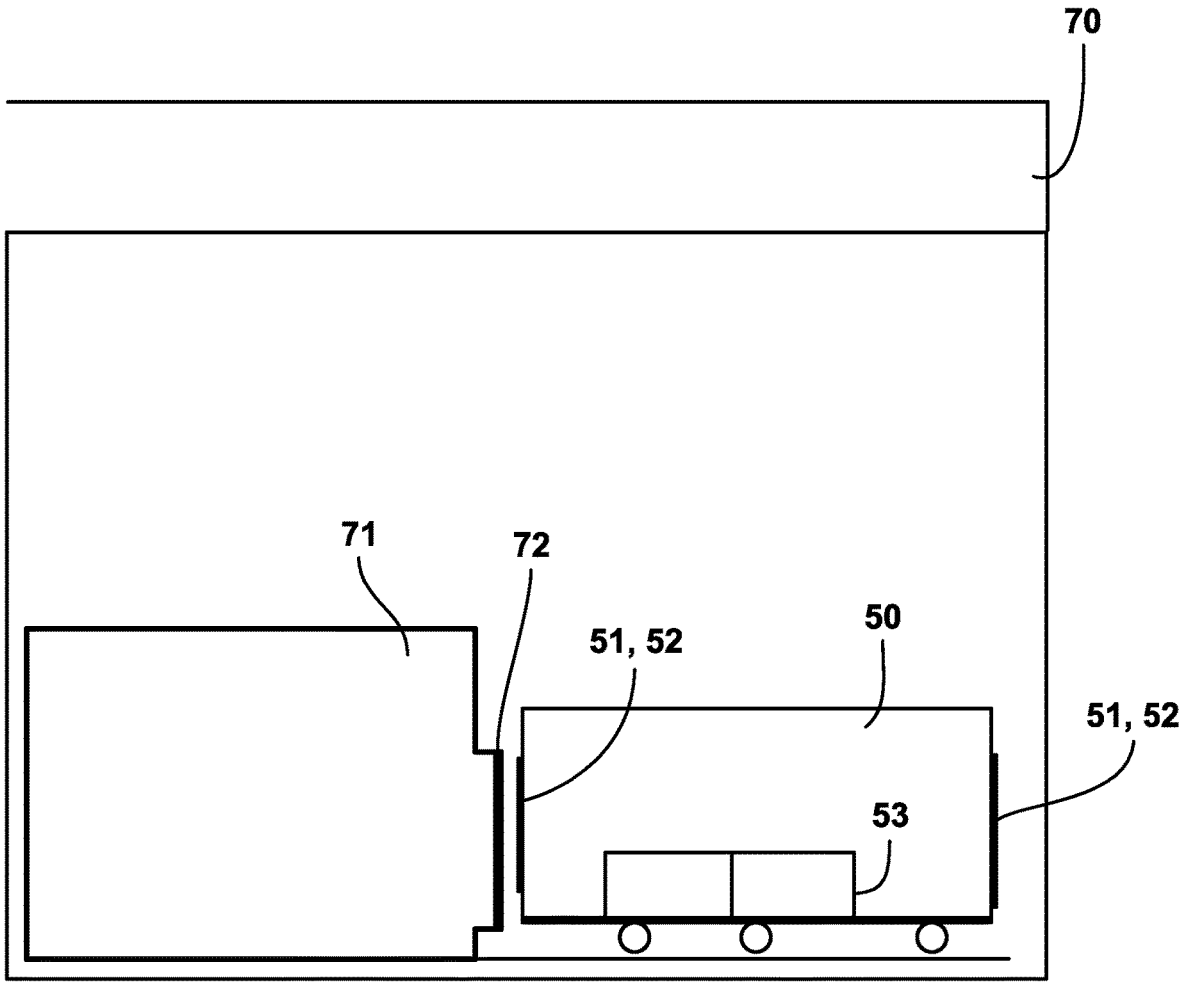
FIG. 18 is a side view of a preferred embodiment of the apparatus of the present invention.

The apparatus of the present invention is an emergency medical vehicle 10, such as a rescue vehicle or ambulance, that can provide emergency hyperbaric oxygen treatment for patients suffering from ailments and illnesses that can be cured or severities lessened in the critical time post incident. The vehicle 10 preferably provides hyperbaric oxygen treatment in route to a health care facility 70 so that the benefits of such treatment can be provided prior to admission into the facility 70. The invention also preferably includes a transfer unit, or TUP (transfer-under-pressure) unit 50, capable of maintaining treatment pressure while transferring the patient from the emergency vehicle 10 to the medical facility 70, as shown in FIGS. 1, 18. The vehicle 10 preferably contains, or at least is adapted to include, the requisite audio sirens and lights required of emergency/rescue vehicles or ambulances pursuant to local and national legal standards.

Figure 8:
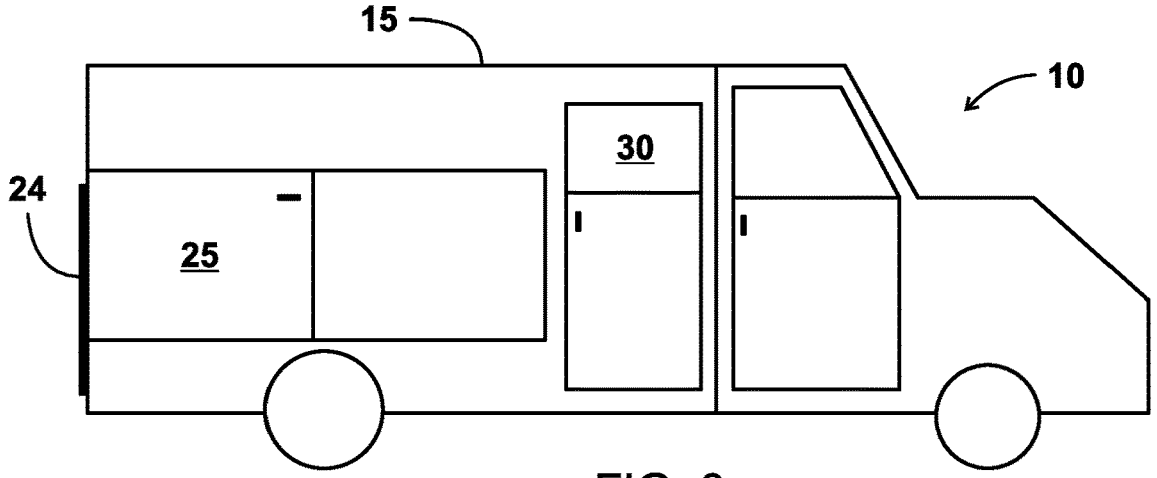
FIG. 8 is an exterior, right side view of a preferred embodiment of a hyperbaric vehicle of the present invention.
Figure 9:
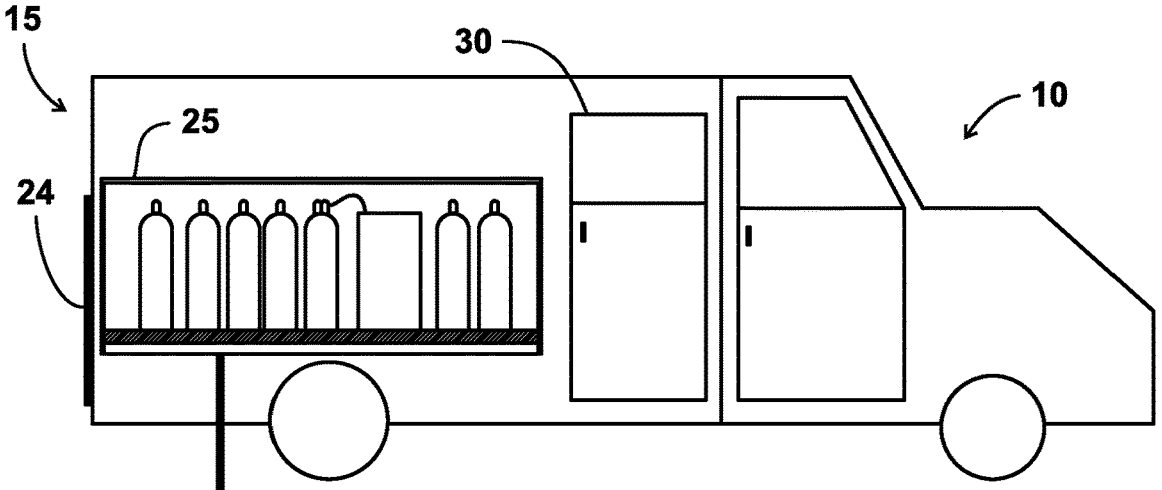
FIG. 9 is a right side view of a preferred embodiment of a hyperbaric vehicle of the present invention showing a cut-away view of a preferred external locker box.
Figure 10:
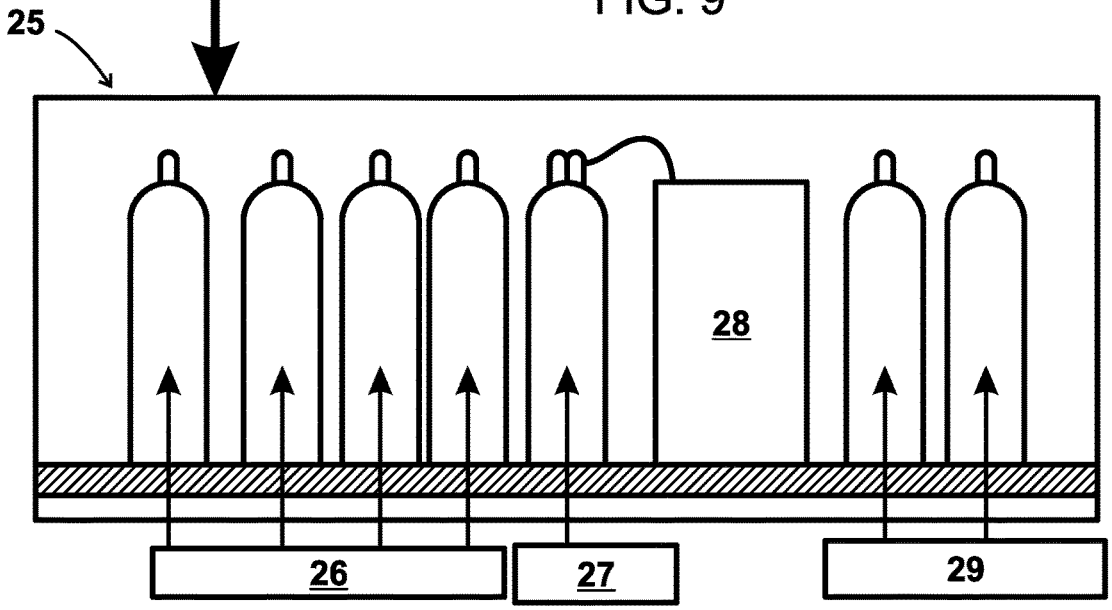
FIG. 10 is an enlarged view of a preferred embodiment of an external locker box of the present invention.
Figure 11:
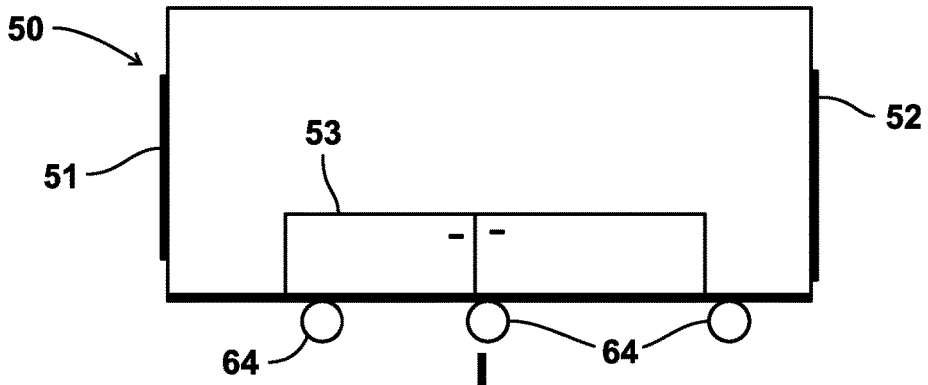
FIG. 11 is an exterior, right side view of a preferred embodiment of a TUP unit of the present invention.
Figure 12:
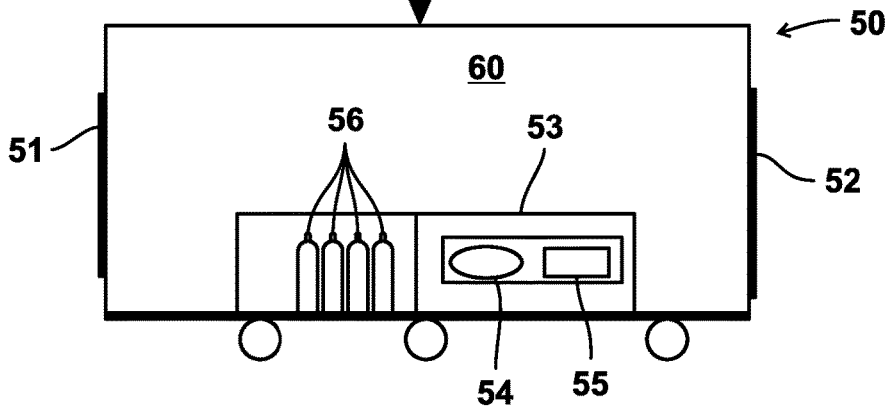
FIG. 12 is a right side view of a preferred embodiment of a TUP unit of the present invention showing a cut-away view of a preferred embodiment of an external locker box.
Figure 13:
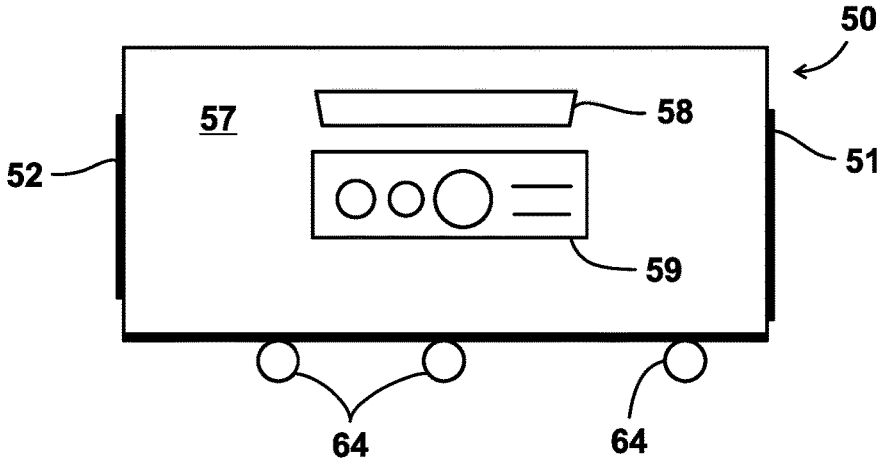
FIG. 13 is an exterior, left side view of a preferred embodiment of a TUP unit of the present invention.
Figure 14:
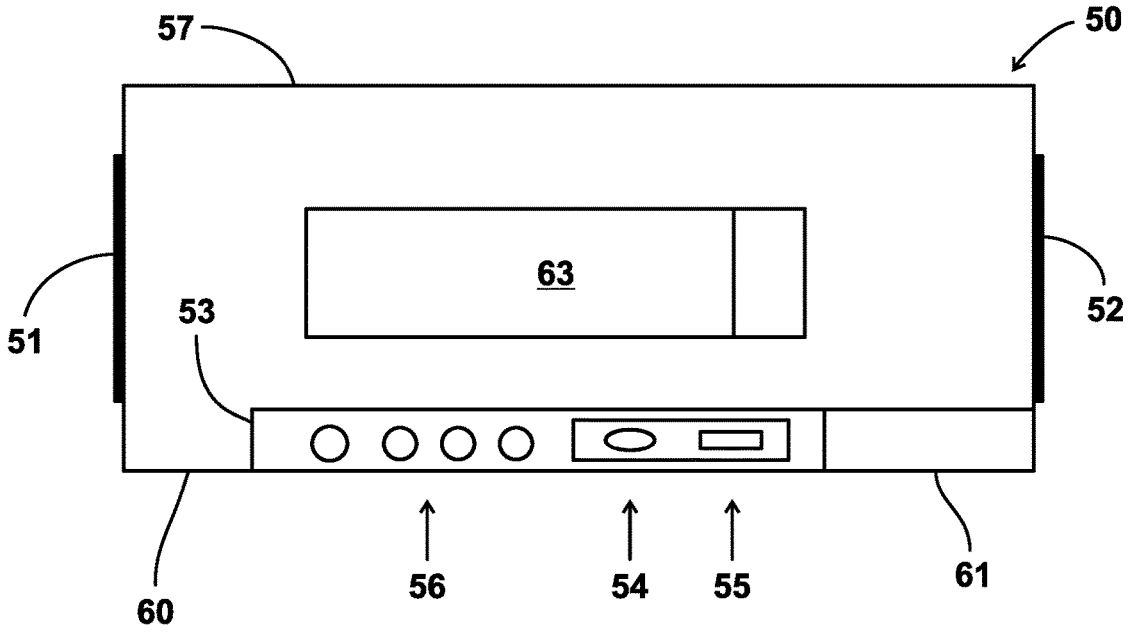
FIG. 14 is an overhead/top, interior view of a preferred embodiment of a TUP unit of the present invention.

The vehicle 10 preferably includes the requisite gases as shown on the right side 15 of the vehicle 10 in FIGS. 8, 9 and 10 for treatment for the patient and for sustaining of the presence of the medical care providers rendering care and support to the patient in the ambulance or vehicle 10. Gases can include high pressure air 26, high pressure $N_2$ tank 27, $H_2O$ fire suppression tank 28, and high pressure $O_2$ tank 29, and can be located in an external locker box 25 of the vehicle 10. External locker box 25 can be provided on either side of vehicle 10.

Figure 3:
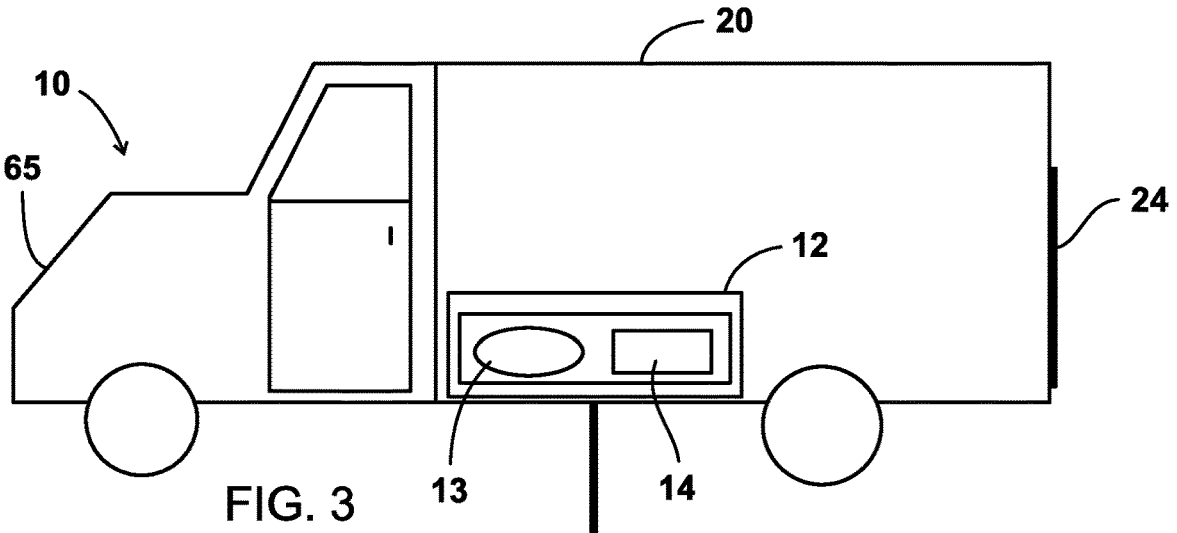
FIG. 3 is a left side view of a preferred embodiment of a hyperbaric vehicle of the present invention showing a cut-away of a preferred embodiment of a locker box.
Figure 4:
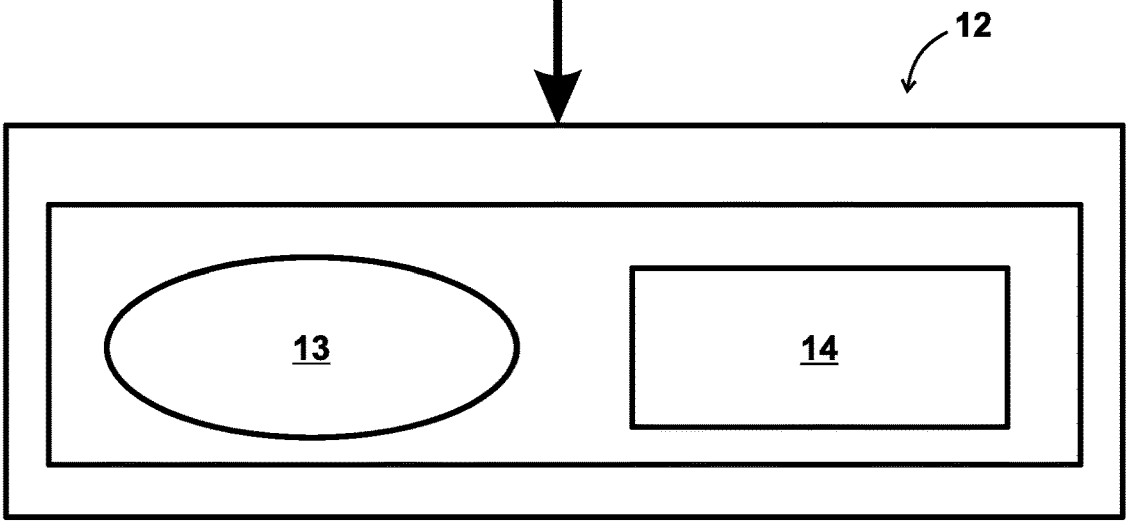
FIG. 4 is an enlarged view of a preferred embodiment of a locker box of the present invention.

Preferably, the vehicle 10 also includes an air receiver 13 and an air compressor 14 for maintaining treatment pressure as shown in FIGS. 3-4. Air receiver 13 and air compressor 14 can be located in a locker box 12 of vehicle 10. Preferably, the high pressure gases or $H_2O$ 26, 27, 28, 29, respectively, air receiver 13, and air compressor 14 are controlled by a technician in the communications and control center 22 of the vehicle 10 using a control panel 23 as shown in FIG. 7.

Figure 5:
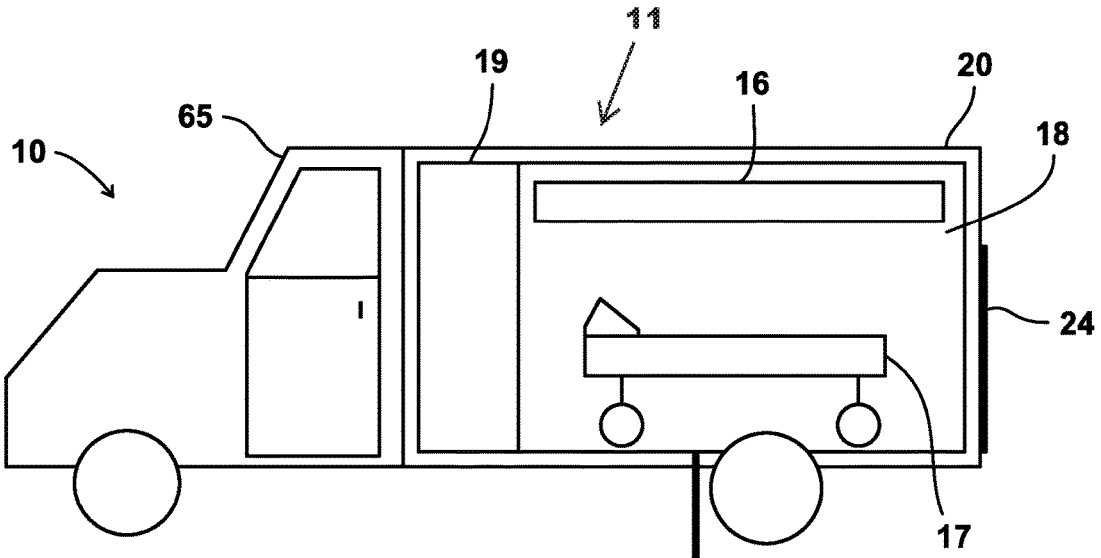
FIG. 5 is a left side view of a preferred embodiment of a hyperbaric vehicle of the present invention showing a cut-away of a preferred embodiment of a hyperbaric treatment chamber.
Figure 6:
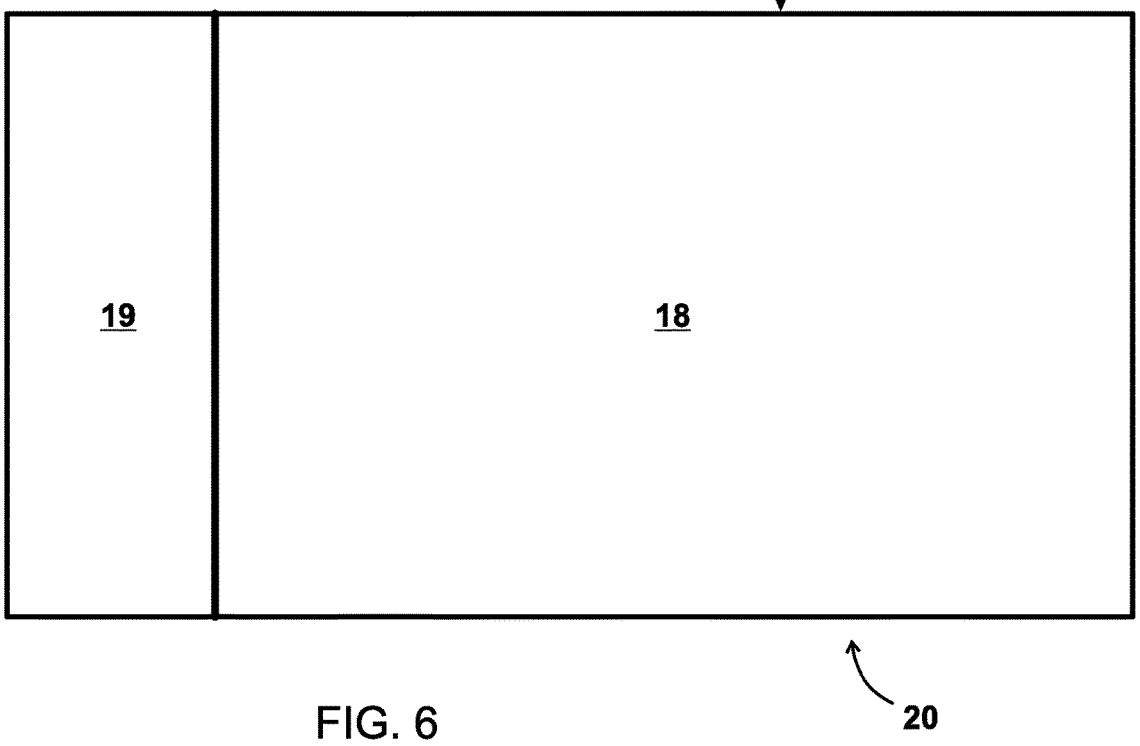
FIG. 6 is an enlarged side view of a preferred embodiment of a hyperbaric treatment chamber.

FIG. 5 is a left-side 11 view of a preferred embodiment of the emergency vehicle 10 of the present invention with a cut away showing the interior of patient treatment area 20. As shown, the vehicle 10 includes a patient area 20 and a driver area/cab 65. In one or more preferred embodiments, the patient area 20 preferably includes at least an entrance/exit lock module 19, and a main hyperbaric treatment chamber 18 as shown in the enlarged patient area view in FIG. 6.

Figure 7:
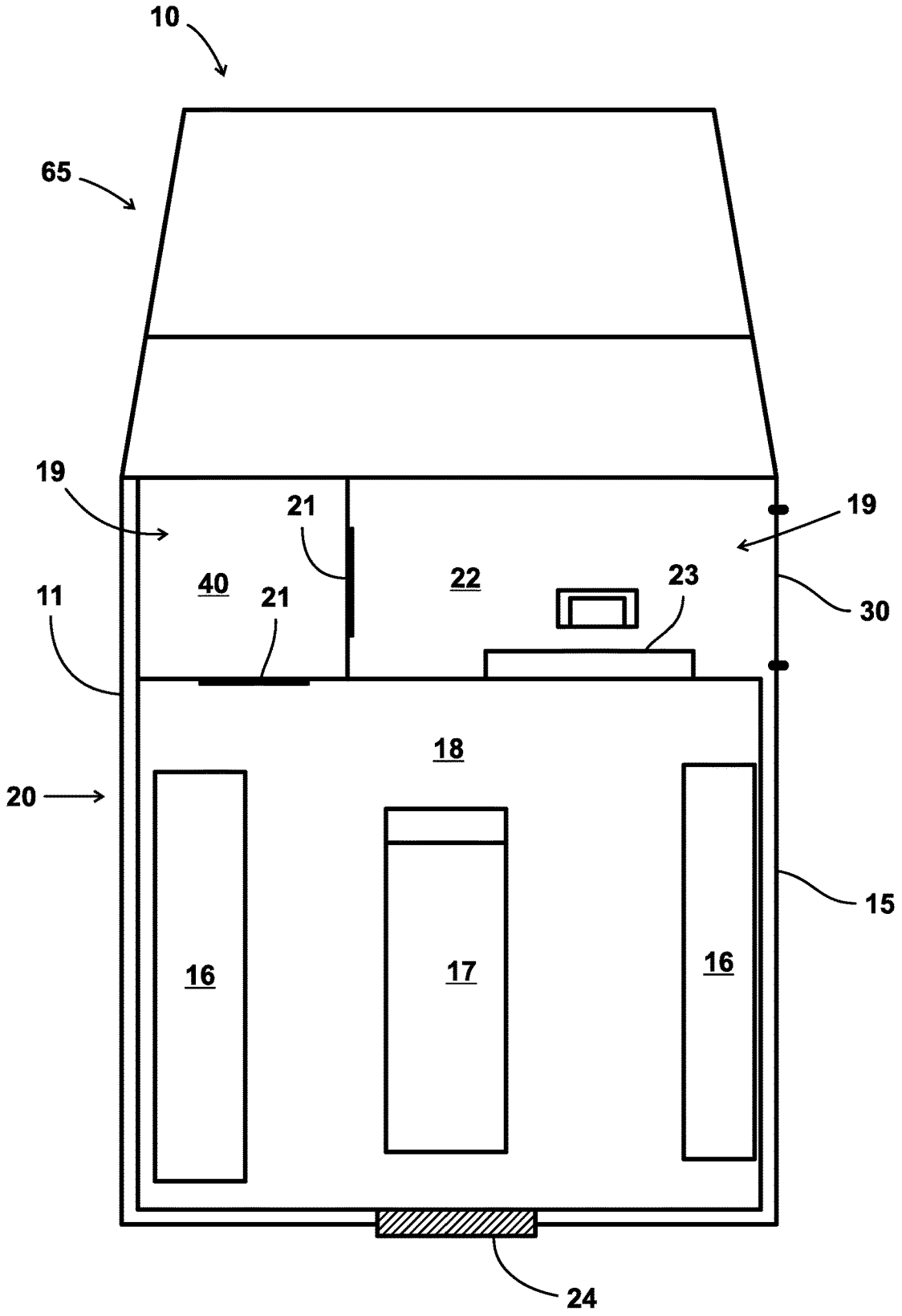
FIG. 7 is an interior, overhead/top view of a preferred embodiment of a hyperbaric vehicle of the present invention.

In one or more preferred embodiments, entrance/exit lock module 19 can include a pressure module/chamber 40 and a non-pressurized chamber/room 41, such as a communications and control center 22 as seen in FIG. 7. In one or more preferred embodiments, entrance/exit lock module 19 can be a pressure module/chamber. In one or more preferred embodiments, entrance/exit lock module 19 can be positioned in between the driver area/cab 65 and the hyperbaric chamber 18. In one or more preferred embodiments, entrance/exit lock module 19 can extend from driver area/cab 65 to hyperbaric chamber 18. In one or more preferred embodiments, entrance/exit lock module 19 is positioned in between control center 22 and hyperbaric chamber 18. In one or more preferred embodiments, entrance/exit lock module 19 is in communication with driver area/cab 65.

Pressure module/chamber 40 can be an intermediate module that can be pressurized and preferably used to allow medical personnel or others to enter/exit the hyperbaric chamber 18 without disrupting the pressure of the chamber 18 and treatment of patient(s). Pressure values in pressure module 40 can be controlled by a technician in the control center 22.

Figure 19:
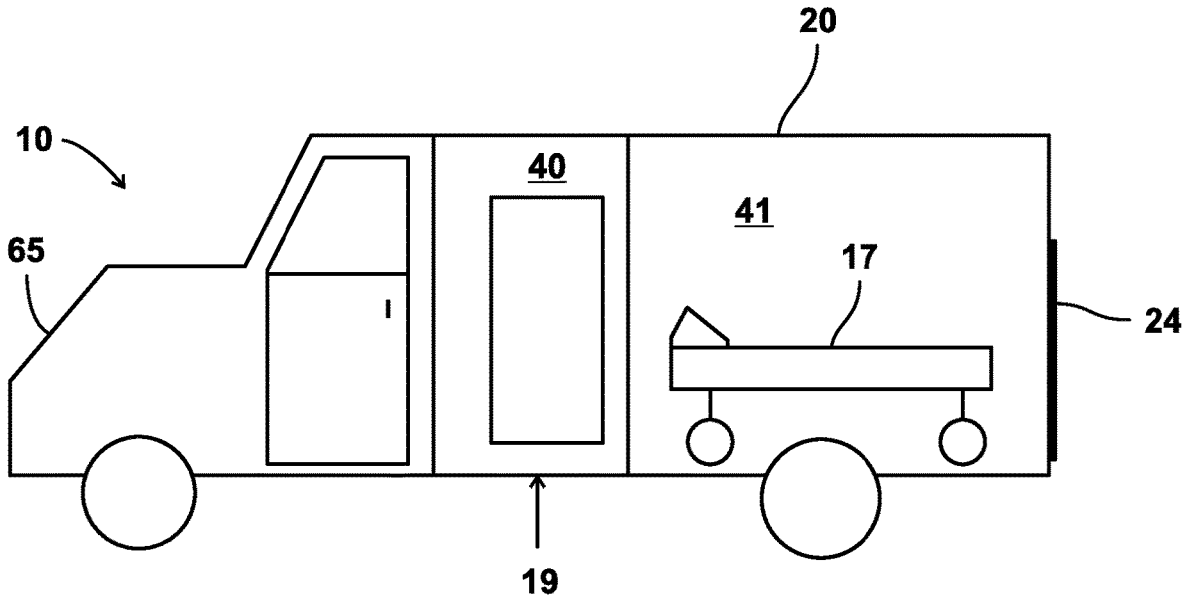
FIG. 19 is a left side view of a preferred embodiment of a hyperbaric vehicle of the present invention showing a cut-away view of a preferred embodiment of a hyperbaric treatment chamber.

In one or more preferred embodiments, entrance/exit lock module 19 can be a separate pressure chamber/module 40 and preferably positioned in front of a non-pressurized treatment area 41 as seen in FIG. 19. FIG. 19 shows patient area 20 including a separate pressure module/chamber 40 in front of a non-pressurized treatment area 41. The non-pressurized treatment area 41 can be for example a conventional ambulance interior.

In one or more preferred embodiments, patient area 20 can include entrance/exit lock module 19 and a hyperbaric treatment chamber 18, wherein entrance/exit lock module 19 can be a non-pressurized module/chamber.

More preferably, the patient area 20 of the vehicle 10 further includes a medical communications and hyperbaric control center 22, as shown in FIG. 7 in an overhead view of the interior of the vehicle 10 of the present invention. The vehicle 10 preferably includes all of the communications capabilities to provide real time information to the destination medical facility 70 in order to provide the medical facility's providers with medical status of the incoming patient.

As shown in FIG. 7, the entrance/exit lock module 19 has a pressure chamber 40 preferably having at least two pressure hatches 21, which allow personnel to enter and exit the main hyperbaric patient treatment chamber 18, and/or the communications center 22, without disrupting the treatment pressure in the main treatment chamber 18. Preferably, personnel can enter/exit the vehicle 10 through a side entrance/exit 30 to the communications center 22 without disrupting the pressure in the main treatment area 18.

In one or more embodiments, a medical provider can enter pressure module 40 preferably through pressure hatch 21 from the control center 22. Preferably, a technician in control center 22 can adjust the pressure values, e.g., increase or decrease the pressure values as needed, in pressure module 40 to equalize with the pressure values in chamber 18. Preferably, when the pressure value of module 40 and chamber 18 are equal or about equal, the medical provider can enter chamber 18 preferably via pressure hatch 21 without loss of pressure in chamber 18.

In one or more embodiments, pressure module 40 can be a type of hyperbaric chamber.

Figure 2:
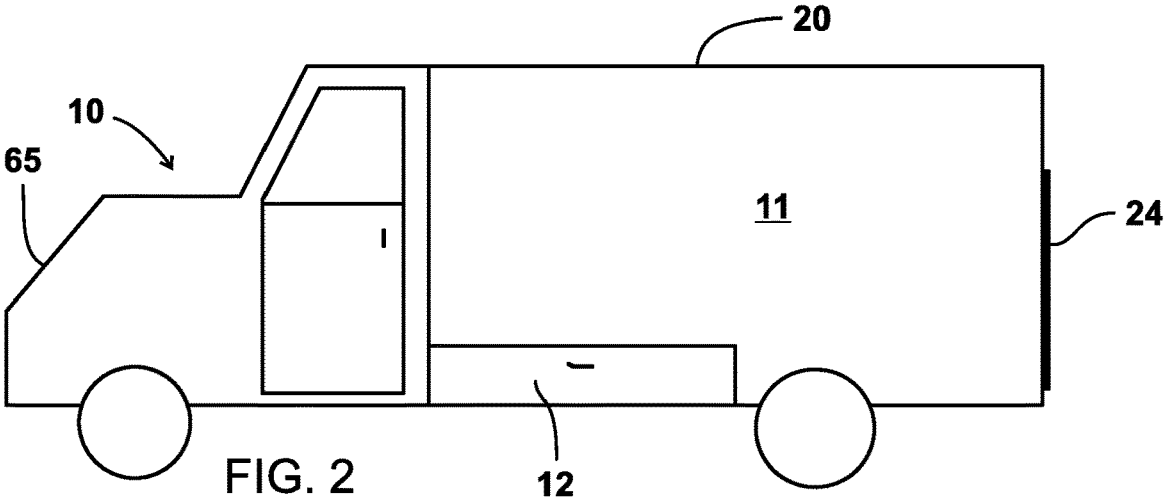
FIG. 2 is an exterior left side view of a preferred embodiment of a hyperbaric vehicle of the present invention.

FIGS. 2-4 show a preferred location for an air receiver 13 and air compressor 14 in a locker box 12 (enlarged in FIG. 4) that are controlled using the control panel 23 in order to maintain the pressure in the main treatment chamber 18 and coordinate entrance and exit of personnel through the entrance lock module 19. Preferably, the vehicle 10 further includes an external locker box 25 containing high pressure air 26, high pressure $N_2$ 27, high pressure $O_2$ 29, and an $H_2O$ fire suppression tank 28 as shown in FIGS. 8-10.

Preferably, the main hyperbaric treatment chamber 18 includes medical supply cabinets 16 and a patient gurney 17, including at least any supplies and monitors typically found in a standard emergency/rescue vehicle, such as a standard ambulance, such that a vehicle 10 of the present invention can be used for standard ambulatory care, both with and without hyperbaric treatment.

Preferably, main hyperbaric treatment chamber 18 also includes a rear pressure lock entrance/exit 24 that allows the patient and personnel to exit vehicle 10 without using entrance/exit 30. Preferably, this rear pressure lock entrance/exit 24 is capable of mating with a front and/or rear transfer lock 51, 52 on a TUP unit 50 of the present invention allowing the patient to be transferred to medical facility 70 without disrupting the treatment pressure, as seen in FIG. 18. Preferably transfer locks 51, 52 of TUP unit 50 are also capable of mating with pressure locks 72 on standard hyperbaric treatment chambers 71 at the medical facility 70 in order to provide a seamless transfer of the patient from the location of injury or pick up by emergency vehicle 10 to medical facility 70 without loss of pressure for hyperbaric treatment.

In order to maintain this pressure, the TUP unit 50 preferably includes an external locker box 53 on a side 57, 60, similar to locker box 12 and external locker box 25 of vehicle 10, where external locker box 53 contains high pressure gas cylinders 56, an air receiver 54, and an air compressor 55. These items are preferably controlled by a separate TUP control panel 59 during transfer. Preferably, a TUP unit 50 also includes a view port 58 and BIBS (Built-In Breathing System) communications console 61 on a side 57, 60 as shown in FIGS. 11-14. Preferably, a TUP unit 50 includes a patient gurney 63.

Figure 15:
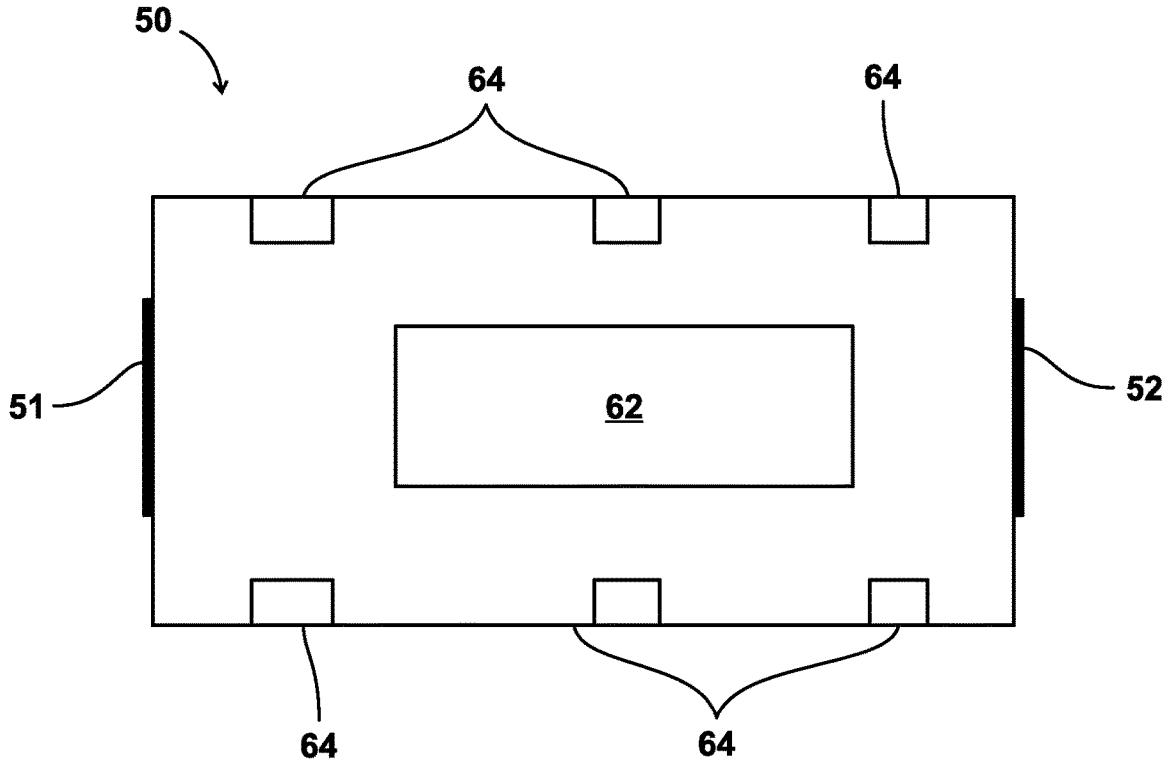
FIG. 15 is a bottom view of a preferred embodiment of a TUP unit of the present invention.
Figures 16, 17:
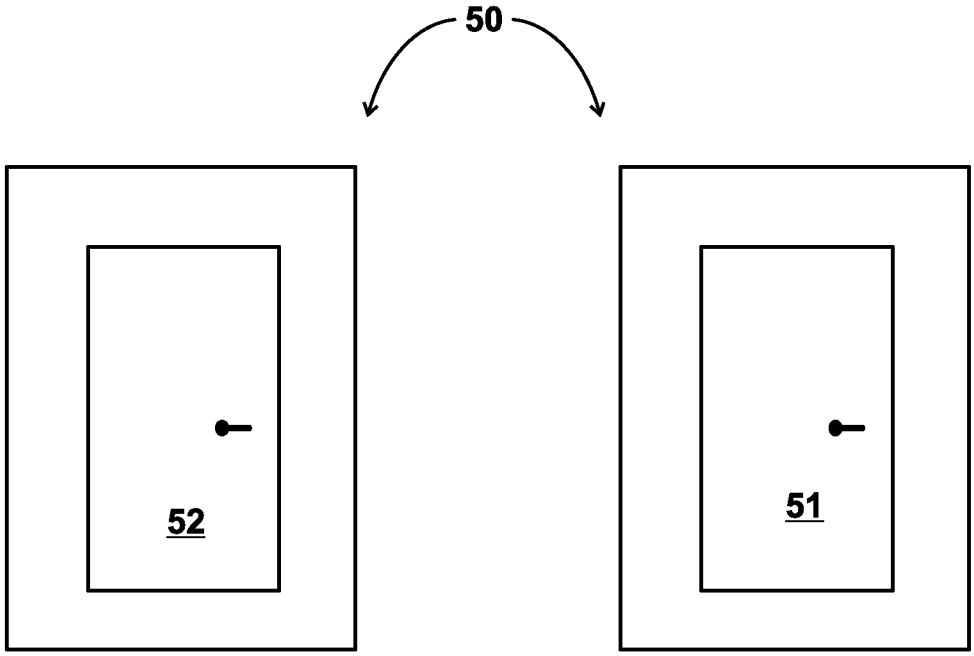
FIG. 16 is a front view of a preferred embodiment of a TUP unit of the present invention.
FIG. 17 is a back view of a preferred embodiment of a TUP unit of the present invention.

More preferably, a TUP unit 50 includes wheels 64 making transfer from vehicle 10 to health care facility 70 easier. Most preferably, a TUP unit 50 also includes a power unit and electric motors 62 that facilitate a smooth transfer from vehicle 10 to health care facility 70 without extra manpower as shown in FIG. 15.

PARTS LIST

The following is a list of parts and materials suitable for use in the present invention:

Parts Number Description

10 vehicle/rescue vehicle/hyperbaric vehicle/ambulance of the present invention/emergency medical vehicle/ambulance
11 left side of rescue vehicle/hyperbaric vehicle/ambulance of the present invention
12 locker box
13 air receiver
14 air compressor
15 right side of rescue vehicle/hyperbaric vehicle/ambulance of
the present invention
16 medical supply cabinets
17 patient gurney
18 interior main hyperbaric treatment chamber
19 entrance/exit lock module
20 patient treatment area/patient area
21 pressure hatch
22 medical communications hyperbaric controls center
23 control panel
24 rear pressure lock entrance/exit
25 external locker box
26 high pressure air
27 high pressure $N_2$
28 $H_2O$ fire suppression tank
29 high pressure $O_2$
30 entrance/exit
40 pressure chamber/pressure module chamber
41 non-pressurized chamber/treatment area
50 TUP (Transfer Under Pressure) unit
51 transfer lock
52 transfer lock
53 external locker box
54 air receiver
55 air compressor
56 high pressure gas cylinders
57 left side
58 view port
59 control panel
60 right side
61 communications BIBS (Built-In Breathing System) console
62 electric motors and power unit
63 patient gurney
64 TUP wheels
65 65 driver area/cab
70 medical facility treatment chamber/health care facility
71 medical facility standing hyperbaric treatment chamber
72 transfer pressure lock All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A vehicle for providing hyperbaric oxygen treatment during transfer of a patient to a medical facility, comprising:

a) a driver section and a vehicle chassis having a patient section that includes a hyperbaric treatment chamber;

b) an entrance module extending from the driver section to the patient section;

c) a communication and control compartment and a pressure module in said entrance module;

d) wherein pressure values of said hyperbaric treatment chamber and the pressure module can be controlled by a technician positioned in the communication and control compartment;

e) wherein the pressure module has at least two pressure hatches, wherein at least one of the at least two pressure hatches allows personnel to enter the pressure module from the communication and control compartment, and at least one of the at least two pressure hatches allows personnel to enter the hyperbaric treatment chamber from the pressure module;

f) wherein said communication and control compartment enables a user to selectively enter or exit said entrance module while simultaneously maintaining a selected elevated pressure value in said hyperbaric treatment chamber of the patient section; and g) wherein said communication and control compartment enables a user to selectively enter or exit said hyperbaric treatment chamber from the entrance module while simultaneously maintaining a selected elevated pressure value in said patient section.

2. The vehicle of claim 1 further including a locker box holding an air receiver and an air compressor for elevating pressure in the hyperbaric treatment chamber.

3. The vehicle of claim 2 wherein the hyperbaric treatment chamber includes one or more medical supply cabinets for storing medical supplies.

4. The vehicle of claim 1 wherein the hyperbaric treatment chamber includes at least two pressure lock entrances, wherein at least one of the at least two pressure lock entrances is the pressure hatch to the entrance module, and at least one of the at least two pressure lock entrances is a pressure lock entrance positioned to an exterior of the vehicle from said hyperbaric treatment chamber.

5. The vehicle of claim 1 further including an external locker box that contains one or more cylinders of high pressure air or gas for maintaining a selected pressure in the hyperbaric treatment chamber.

6. The vehicle of claim 5 further including an $H_2O$ fire suppression tank.

7. The vehicle of claim 6 wherein the vehicle has a side entrance that allows personnel to access the communication and control compartment.

8. The vehicle of claim 4 wherein said pressure lock entrance from the hyperbaric treatment chamber to the exterior of the vehicle is configured to mate with a pressure lock of a transfer-under-pressure (TUP) unit.

9. The vehicle of claim 8 wherein the TUP unit includes front and rear transfer locks, an external locker box, a view port, and a control panel, wherein at least one of the transfer locks is able to mate with the pressure lock of the hyperbaric treatment chamber of the vehicle, and at least one of the transfer locks is able to mate with a pressure lock of a hyperbaric treatment chamber in a medical facility, and wherein the external locker box contains at least an air receiver, an air compressor, and high pressure gas cylinders for maintaining a selected elevated pressure value for the patient during transfer from the vehicle to the medical facility.

10. The vehicle of claim 9 wherein the TUP further includes a power unit that is capable of moving the TUP at least the distance from the vehicle to a medical facility hyperbaric treatment chamber.

11. The vehicle of claim 9 wherein the TUP further includes wheels to aid in moving the TUP from the vehicle to the medical facility.

12. A vehicle for providing hyperbaric oxygen treatment during transfer of a patient to a medical facility, comprising:

a) a driver section and a vehicle chassis having a patient section that includes a hyperbaric treatment chamber;

b) an entrance module positioned in between the driver section and the patient section, said entrance module including a communication and control compartment and a pressure module;

c) wherein pressure values of said hyperbaric treatment chamber and the pressure module can be controlled by a technician positioned in the communication and control compartment;

d) wherein the pressure module has at least two pressure hatches, wherein at least one of the at least two pressure hatches allows personnel to enter the pressure module from the communication and control compartment, and at least one of the at least two pressure hatches allows personnel to enter the hyperbaric treatment chamber from the pressure module;

e) wherein the hyperbaric treatment chamber includes at least two pressure lock entrances, wherein at least one of the at least two pressure lock entrances is the pressure hatch to the entrance module, and at least one of the at least two pressure lock entrances is a pressure lock entrance to the exterior of the vehicle from said hyperbaric treatment chamber;

f) wherein said pressure module enables a user to selectively enter or exit said entrance module while simultaneously maintaining a selected elevated pressure value in said patient section; and g) wherein said pressure module enables a user to selectively enter or exit said hyperbaric treatment chamber from the entrance module while simultaneously maintaining a selected elevated pressure value in said patient section.

13. The vehicle of claim 12 wherein the entrance module has one or more doors that enable medical personnel to enter and exit the hyperbaric treatment chamber without disrupting the elevated pressure value established in the hyperbaric treatment chamber.

14. The vehicle of claim 12 further including a locker box holding an air receiver and an air compressor for elevating pressure in the hyperbaric treatment chamber.

15. The vehicle of claim 12 further including an external locker box that contains one or more cylinders of high pressure air or gas for maintaining a selected pressure in the hyperbaric treatment chamber.

16. The vehicle of claim 12 wherein the vehicle has a side entrance that allows personnel to access the communication and control compartment.

17. The vehicle of claim 12 wherein said pressure lock entrance from the hyperbaric treatment chamber to the exterior of the vehicle is configured to mate with a pressure lock of a transfer-under-pressure (TUP) unit.

18. The vehicle of claim 17 wherein the TUP unit includes front and rear transfer locks, an external locker box, a view port, and a control panel, wherein at least one of the transfer locks is able to mate with the pressure lock of the hyperbaric treatment chamber of the vehicle, and at least one of the transfer locks is able to mate with a pressure lock of a hyperbaric treatment chamber in a medical facility, and wherein the external locker box contains at least an air receiver, an air compressor, and high pressure gas cylinders for maintaining a selected elevated pressure value for the patient during transfer from the vehicle to the medical facility.

19. The vehicle of claim 18 wherein the TUP further includes a power unit that is capable of moving the TUP at least the distance from the vehicle to a medical facility hyperbaric treatment chamber.

20. The vehicle of claim 18 wherein the TUP further includes wheels to aid in moving the TUP from the vehicle to the medical facility.

* * * * *